US006811051B2

(12) United States Patent
Higuchi

(10) Patent No.: US 6,811,051 B2
(45) Date of Patent: Nov. 2, 2004

(54) METAL CONTAINER CAPABLE OF RETAINING A STATE OF BEING REDUCED IN A LONGITUDINAL DIRECTION AND REDUCTION METHOD THEREOF

(75) Inventor: Mitsuo Higuchi, Yamanashi (JP)

(73) Assignee: Gohsho Company, Ltd., Yamanashi (JP)

( * ) Notice: Subject to any disclaimer, the term of this patent is extended or adjusted under 35 U.S.C. 154(b) by 193 days.

(21) Appl. No.: 10/094,634

(22) Filed: Mar. 12, 2002

(65) Prior Publication Data

US 2003/0141310 A1 Jul. 31, 2003

(30) Foreign Application Priority Data

Jan. 31, 2002 (JP) ..... 2002-023667

(51) Int. Cl.[7] ..... B65D 1/40

(52) U.S. Cl. ..... 220/666; 220/667

(58) Field of Search ..... 220/667, 666

(56) References Cited

U.S. PATENT DOCUMENTS

| | | | | | |
|---|---|---|---|---|---|
| 2,139,143 | A | * | 12/1938 | Kalina | 222/82 |
| 3,353,700 | A | * | 11/1967 | Wiswell | 220/667 |
| 3,872,994 | A | * | 3/1975 | Hyde | 220/667 |
| 5,137,171 | A | * | 8/1992 | Goeppner | 220/667 |
| 5,397,021 | A | * | 3/1995 | Usui | 220/667 |

* cited by examiner

*Primary Examiner*—Joseph Man-Fu Moy
(74) *Attorney, Agent, or Firm*—Reed Smith LLP; Stanley P. Fisher, Esq.; Juan Carlos A. Marquez, Esq.

(57) ABSTRACT

To reduce the volume of a metal container body after the juice or beer contained therein has been consumed, the container body/wall is formed with accordion-shaped portions having horizontal ring-shape hill portions valley portions.

15 Claims, 11 Drawing Sheets

【Fig. 1】
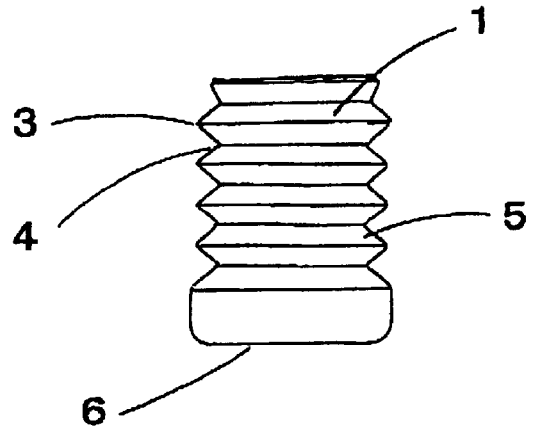
【Fig. 2】
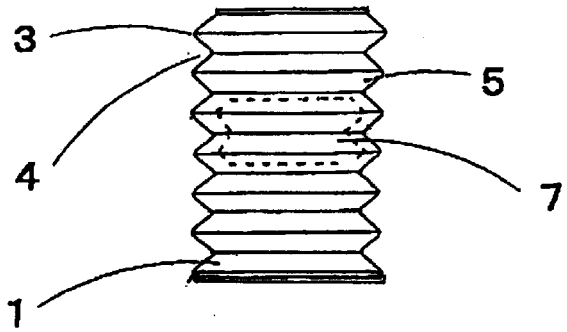
【Fig. 3】
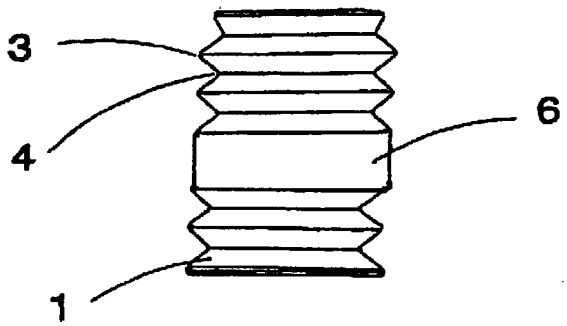

【Fig. 4】
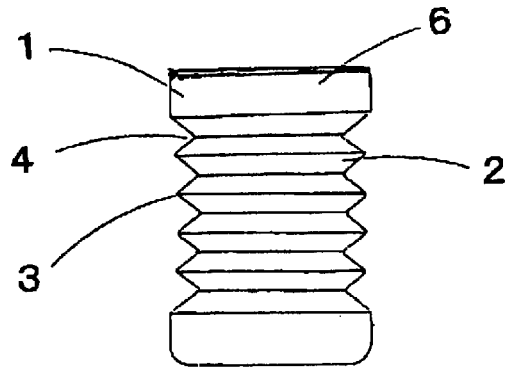
【Fig. 5】
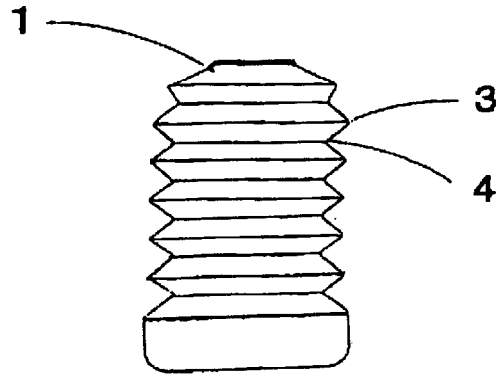
【Fig. 6】
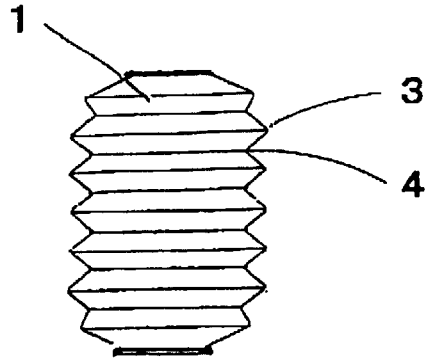

【Fig. 7】
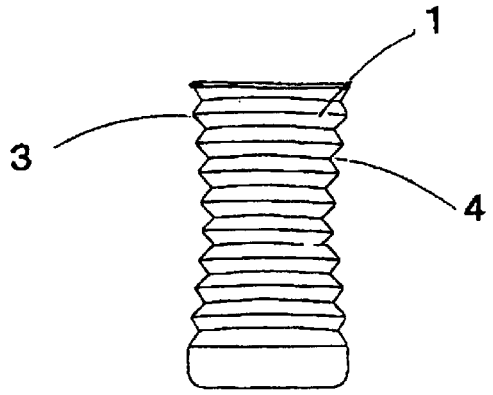
【Fig. 8】
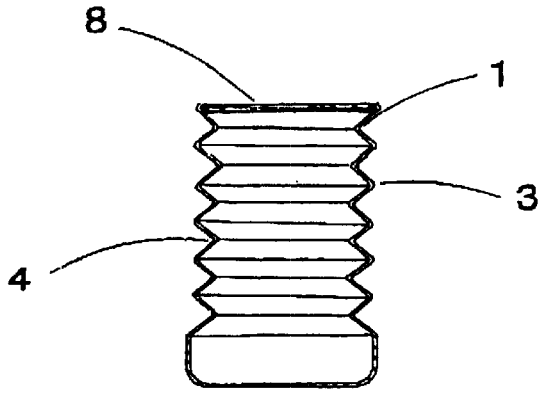
【Fig. 9】
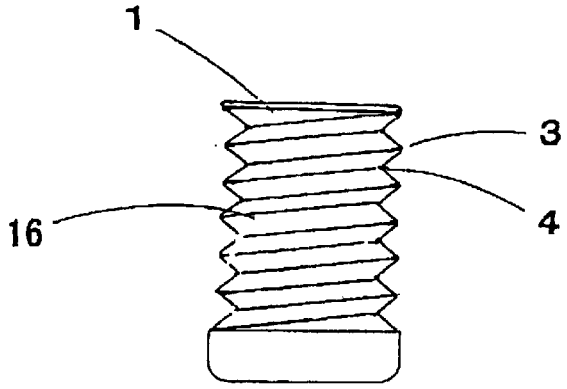

【Fig. 10】
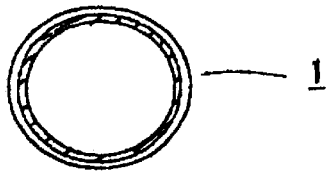
【Fig. 11】
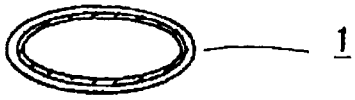
【Fig. 12】
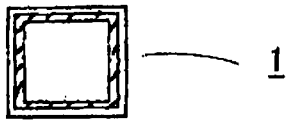
【Fig. 13】
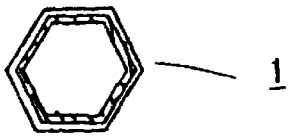
【Fig. 14】
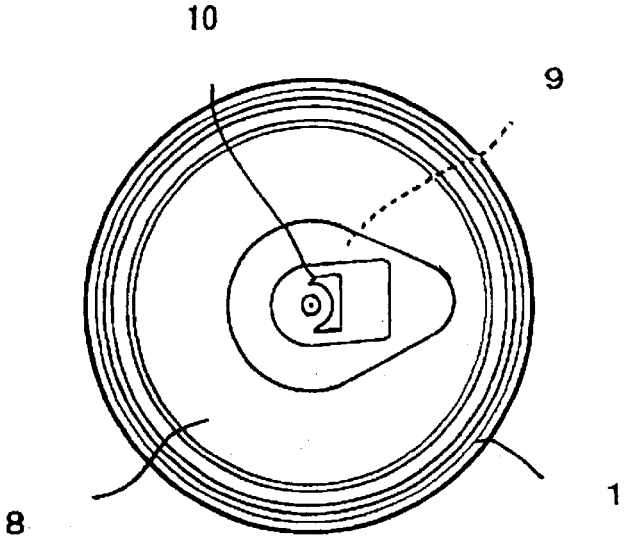

【Fig. 15】
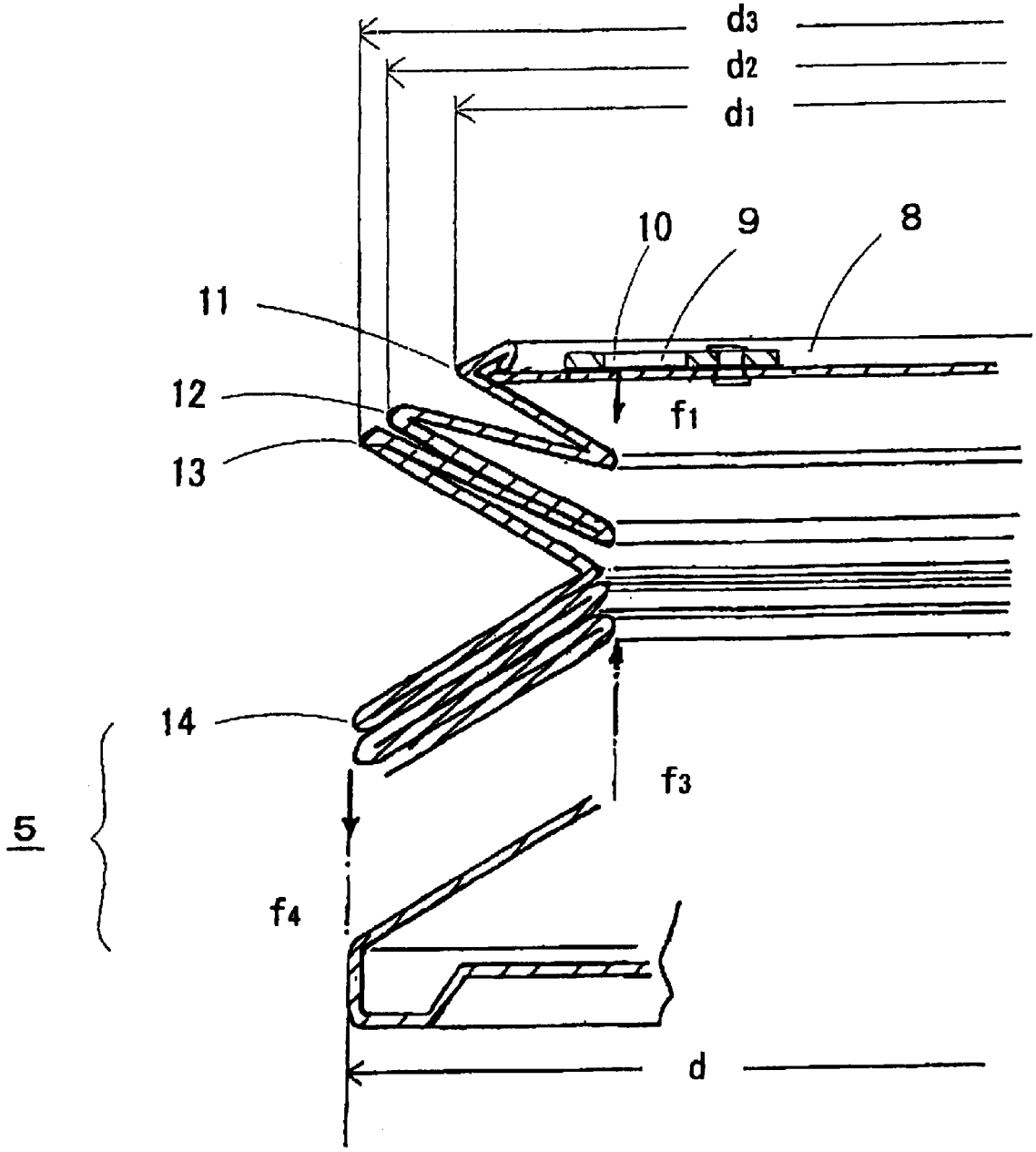

【Fig. 16】
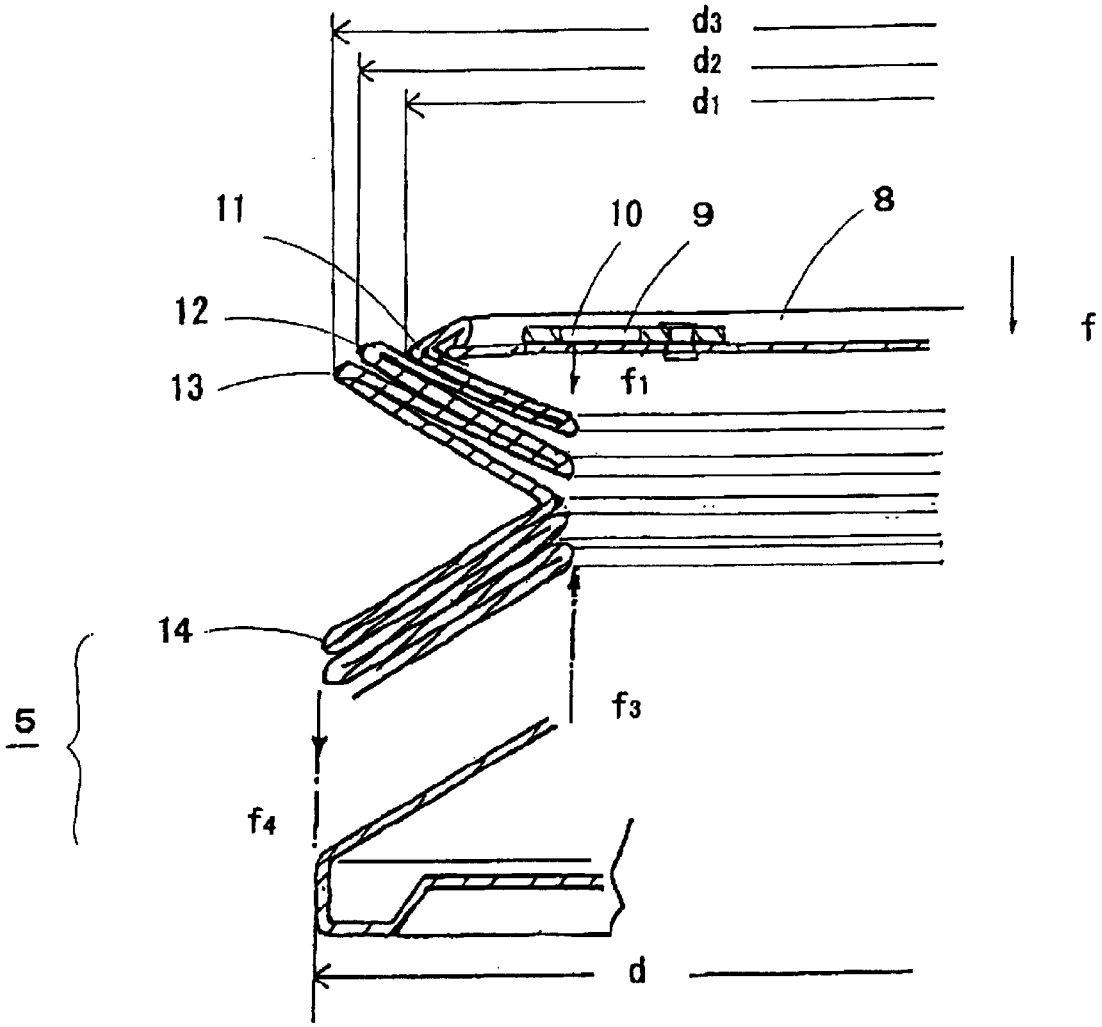

【Fig. 17】
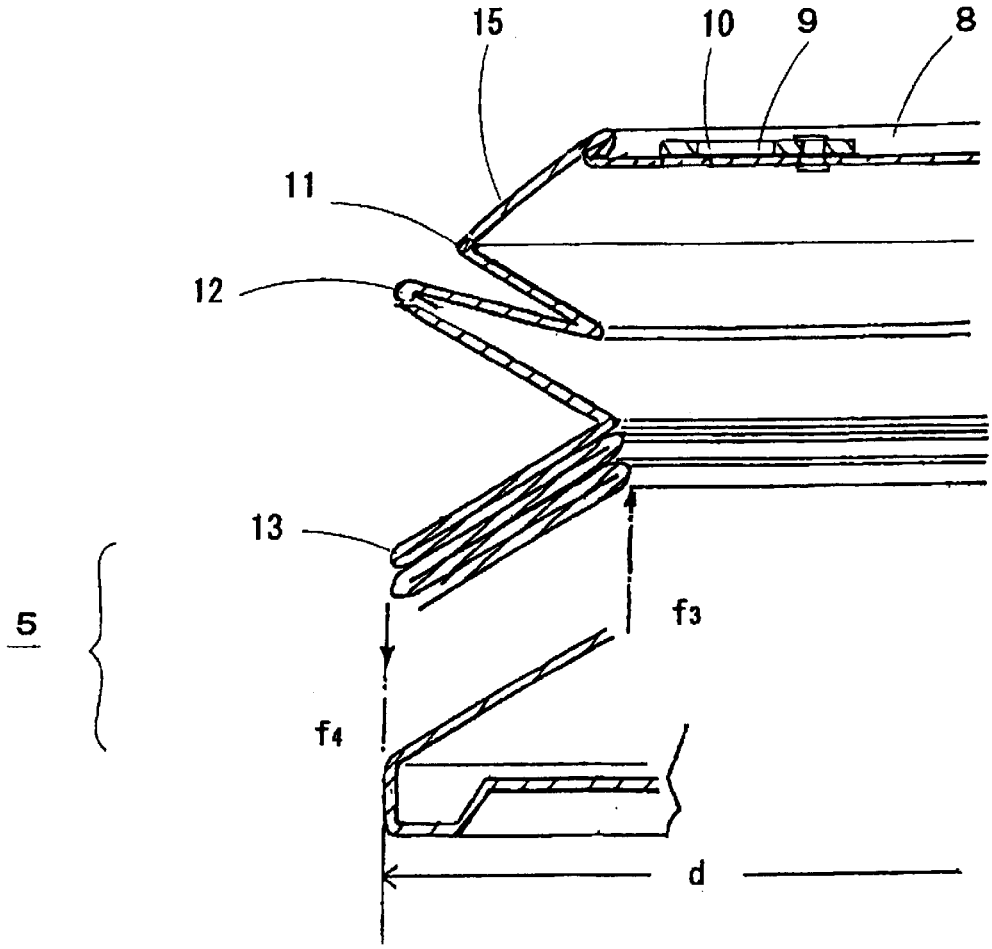
【Fig. 18】
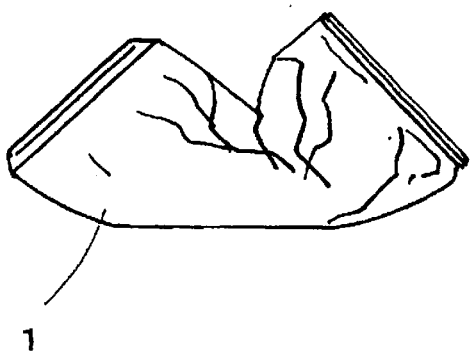

METAL CONTAINER CAPABLE OF RETAINING A STATE OF BEING REDUCED IN A LONGITUDINAL DIRECTION AND REDUCTION METHOD THEREOF

BACKGROUND OF THE INVENTION

1. Field of the Invention

The present invention relates to a container for beer, juice or tea, which is formed of a metal material such as aluminum or stainless steel, and more particularly to a container which is capable of being reduced in a longitudinal direction (the container volume is decreased) when the contents thereof have been consumed.

2. Description of the Related Art

In recent years, there has been an expansion in the manufacturing of such types of metal containers. However, when the juice or beer contained in the container body has been consumed and the container is to be disposed of, the container body still has its original shape, and even in a rare case when the container has been trampled under foot so as to reduce its volume, as illustrated in FIG. 18, a container body (1) retains panels at both sides (top and bottom sides). As a result, the size of the container body is substantially the same as it was prior to the contents being consumed, and when this container is thrown in a so-called trash can, it is as if air was being discarded into the trash can and it becomes full very quickly. As a result, these containers are often thrown on the streets and that causes deterioration of the living environment. Also, a labor cost for collection of these container bodies becomes a huge burden on public works.

In addition, these metal containers are manufactured by a simple means from very thin sheets of aluminum or stainless steel, but when they are subjected to strong vibrations of motor vehicles or transporting means, or when the containers are stacked in a storefront display, their strength is insufficient.

Further, when these containers are transported from a container manufacturer to a bottler, since the container bodies are large, it is as if air were being transported. As a result, the proportion of the transportation cost of the product is quite high.

SUMMARY OF THE INVENTION

An object of the present invention is to make it possible for the volume of a metal container body to be greatly reduced after the juice or beer contained therein has been consumed and the container is to be disposed of, and thus a number of empty container bodies that can be accommodated in a trash can, is much greater than a limited number of empty container bodies of a conventional type which could be accommodated therein.

Also, another object of the present invention is to achieve a great reduction in a labor cost for trash collection by making it possible for a large number of empty containers to be transported simultaneously.

Further, when the containers are transported from manufacturers of the containers to bottlers, a number of containers that can be transported at once is increased greatly as compared to a number of the containers of a conventional type that could be transported at once.

Also, as described above, an object of the invention is to provide a container of which volume can be reduced when it is disposed of after the contents thereof are consumed, or when it is being transported. However, it is also an object to provide a container body such that when the volume thereof is reduced, the reduced state is retained for a long time or long period or up until the operation of crushing or melting is carried out for the purpose of recycling, without occurrence of a restoring force.

It must be noted that the overall shape of a metal container of the present invention is one suitably selected from all elliptical cylinder (FIG. 21A), a circular cylinder, a rectangular column (FIG. 22A), a truncated cone (FIG. 19) or a truncated pyramid (FIG. 20) an hourglass drum shape (FIGS. 21B, 22B, 23B) and a barrel shape. The shape of a horizontal sectional view is suitably selected from an ellipse (FIG. 11) a circle (FIG. 10), a polygon (FIG. 13), and a rectangle (FIG. 12).

Another object of the present invention is to make it possible to enlarge the surface area of the container, compared to a conventional one, on which a label showing contents, a trademark or the like is fixed or on which its contents or a trademark is directly printed.

It is also to be noted that the container is provided such that, as a drink container, the form of the exterior of the container body is esthetically pleasing, and thus appealing to consumers. Also a consideration is given to preventing the container from slipping and dropping while being used, and to preventing the contents from spilling. Further, the container is provided so as to be capable of remaining in the state of being reduced in its longitudinal direction and the present invention also proposes a method of reduction thereof.

A feature of the invention is that the outer periphery and inner periphery (2) of a container body (1) having a cylindrical shape are formed as accordion-shaped portions (5) including hill portions (3) and valley portions (4) having an annular shape in a horizontal direction.

Another feature of the present invention is that a diameter of one outer periphery configuration of the accordion-shaped portions (5) of the metal container body (1) is smaller than a diameter of other outer periphery configurations.

Another feature of the present invention is that a diameter of one outer periphery configuration of the accordion-shaped portion (5) of the metal container body (1) is smaller than a diameter of another outer periphery configuration, and the other outer periphery configurations are successively larger, with the lowest outer periphery configurations having the same diameter.

Another feature of the present invention is a that diameter of an outer periphery configuration of the accordion-shaped portion (5) of the container body (1), is smallest at a substantially central portion of said container body, and said diameter increases toward outer directions.

Another feature of the present invention is that the hill portions (3) and the valley portions (4) of the outer periphery configuration of the accordion-shaped portion (5) of the container body (1) are formed as alternating spirals.

Another feature of the present invention is that when a force is applied in a substantially perpendicular direction with respect to the horizontal or spiral accordion-shaped portions (5) which are along the entire length, or along a portion of the length in the longitudinal direction of the container body (1), a force acting in one direction is exerted on a part of an inner periphery and/or a fold constituting the accordion-shaped portion (5), and an opposing force acts on the outer periphery so that the accordion-shaped portions retain a state of being reduced in the longitudinal direction.

Another feature of the present invention is applying a force in a substantially perpendicular direction with respect to the horizontal or spiral accordion-shaped portions (5) which are along the entire length, or along a portion of the length in the longitudinal direction of the container body (1), and exerting a pressing force acting in one direction on a part of an inner periphery and/or a fold constituting the accordion-shaped portion (5) causing an opposing force acts on the outer periphery so that the accordion-shaped portions retain a state of being reduced in the longitudinal direction.

Another feature of the present invention is that the overall shape of the container body (1) is suitably selected from an elliptical cylinder, a circular cylinder, a rectangular column, a truncated cone or a truncated pyramid, and an hourglass drum shape.

Another feature of the present invention is the hill portion (3) of the accordion-shaped portions (5) formed at, at least the top of the container body (1) are configured such that an upper vicinity is slightly longer than a lower vicinity and said upper vicinity has an arc configuration (15).

Another feature of the present invention is that horizontal cross-section of the container body (1) is suitably selected from an ellipse, a circle and a rectangle.

Another feature of the present invention is that a label on which product contents, product information and trademarks are printed, is fixed onto the outer periphery of the container body (1).

Another feature of the present invention is that the container body (1) is provided with a tap portion which can be caused to protrude in an upward direction from a central portion of said container body (1), and horizontal accordion-shaped portion are formed at inner and outer walls of the container body in the entire length (height) direction or in a portion of said direction, and the diameter of accordion-shaped portion (5) is smaller at the top of the container body than that at the bottom, and the diameter increases sequentially as the bottom of the container body is approached, so that when force is applied in a substantially perpendicular direction with respect to the accordion-shaped portions (5), a force acts downward in the inner diameter direction of the wall of the upper accordion-shaped portions (5) and upwards in the outer diameter direction, and another force acts downwards in the inner diameter direction of the folds of the upper accordion-shaped portions (5) so that the accordion-shaped portions retain a state in which the length (height) of the container body (1) is reduced.

The foregoing and other objects, features and operational effects of the present invention will be apparent from the following description of the examples.

BRIEF DESCRIPTION OF THE DRAWINGS

FIG. 1 is a front view of an example of a metal container body of the present invention;

FIG. 2 is a front view of another example of a metal container body;

FIG. 3 is a front view of another example of a metal container body;

FIG. 4 is a front view of another example of a metal container body;

FIG. 5 is a front view of another example of a metal container body;

FIG. 6 is a front view of another example of a metal container body;

FIG. 7 is a front view of another example of a metal container body;

FIG. 8 is a front view of another example of a metal container body;

FIG. 9 is a front view of another example of a metal container body;

FIG. 10 is a round cross sectional view of another example;

FIG. 11 is an elliptical cross sectional view of another example;

FIG. 12 is a square cross sectional view of another example;

FIG. 13 is a polygonal cross sectional view of another example;

FIG. 14 is an enlarged view of the surface of a container body.

FIG. 15 is a partially cutaway longitudinal sectional view of a container body in a state in which it is being crushed;

FIG. 16 is a partially cutaway longitudinal sectional view of a container body in a state in which it is has been crushed;

FIG. 17 is a partially cutaway longitudinal sectional view of another container body in a state in which it is being crushed; and FIG. 18 is a front view of a conventional can in a state in which it has been pressed and crushed.

EXAMPLES

Figure 19:
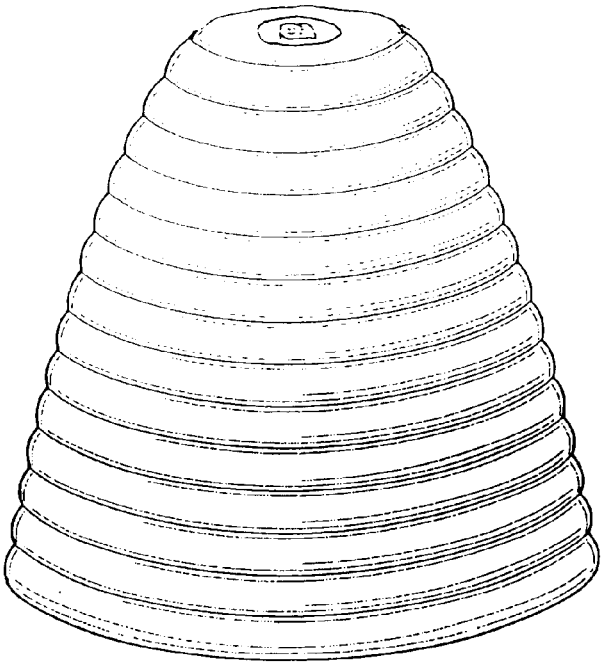
FIG. 19 is a perspective view of a circular cone-shaped container according to the invention.
Figure 20:
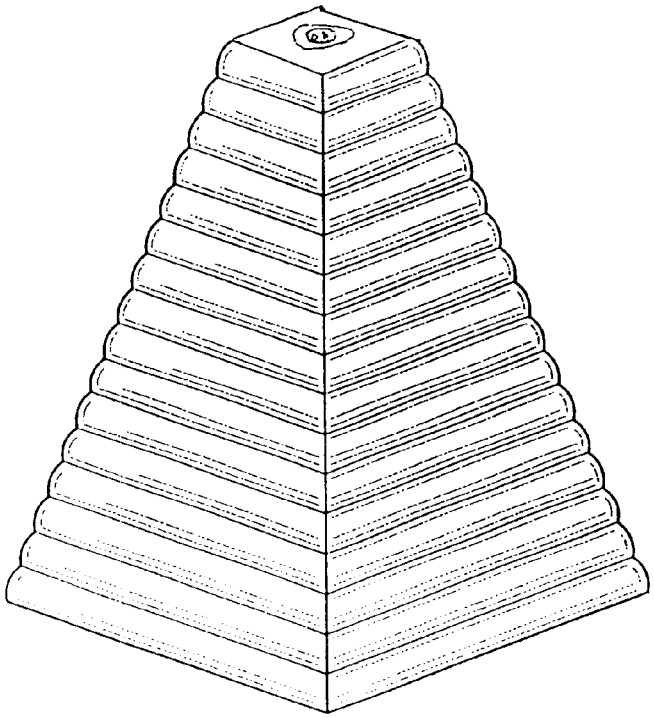
FIG. 20 is a perspective view of a pyramid-shaped container according to the invention.
Figure 21A:
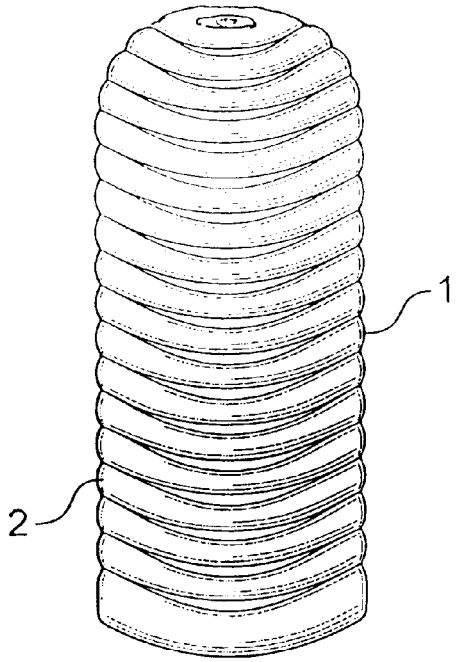
FIG. 21A is a perspective view of a container shaped as an ellipse cylinder according to the invention.
Figure 21B:
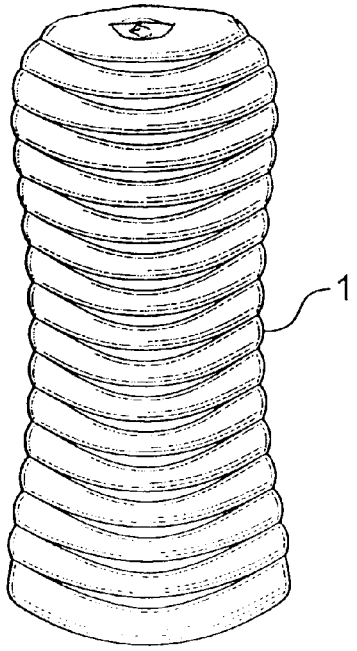
FIG. 21B a perspective view of a container shaped as a hourglass shaped ellipse cylinder according to the invention.
Figure 22A:
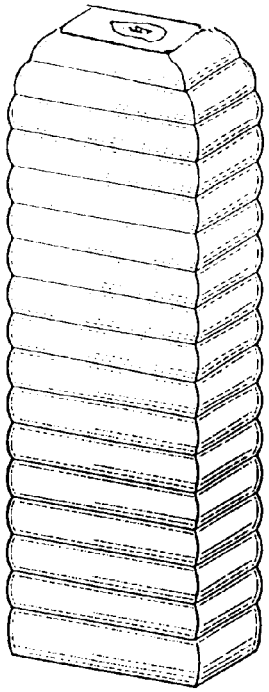
FIG. 22A is a perspective view of a container shaped as a rectangular column according to the invention.
Figure 22B:
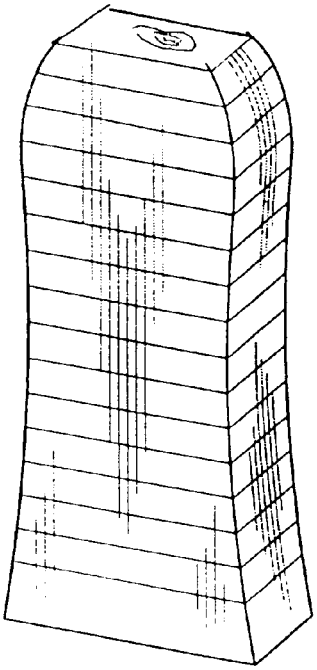
FIG. 22B a perspective view of a container, shaped as a hourglass shaped rectangular column according to the invention.
Figure 23A:
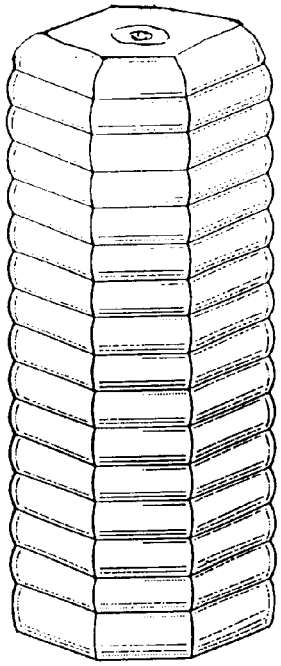
FIG. 23A is a perspective view of a container shaped as a polygon column according to tile invention.
Figure 23B:
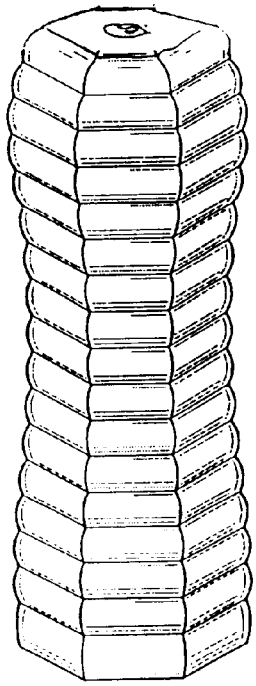
FIG. 23B a perspective view of a container shaped as a hourglass shaped polygon column according to the invention.

Examples of the present invention, which are illustrated in the drawings, will be described below.

In the Figures, (1) is a container body formed in a cylindrical shape from extremely thin aluminum or stainless steel material. The outer periphery and inner periphery (2) in the height (length) direction have accordion-shaped portions (5) in which the horizontal hill portion (3) and the valley portion (4) are alternately stacked in the vertical direction. The container illustrated in FIG. 1 is accordion-shaped along the entire height direction. However, the bottom end portion may be made flat (6) and this may be used as a section for displaying trademarks and product contents.

The section for displaying the trademark and the product contents does not need to be a flat (6), and can of course be the surface (7) of the accordion-shaped portion (5) as illustrated in FIG. 2. In this case, the surface area is greater than in the case where the flat (6) of FIG. 1 is used. Also in this case, a logo for advertising which is more appealing to the consumer, can be designed.

Further, in FIG. 4, the flat (6) for advertising and the like is provided at the center line in the horizontal direction of the container body (1) and in FIG. 5, the flat (6) is provided at the upper and lower directions.

FIGS. 15 and 16 illustrate the container body (1) in a state in which the beer contained therein has been consumed and the can has been pressed and crushed from one side in the height (length) direction or from both sides in said direction. That is to say, the container body (1) of the present invention has an excellent construction so that this state in which it is pressed and crushed can be achieved and an excellent working is exhibited.

In FIG. 15, 8 is the surface portion of the container body (1) and includes a metal member (10) for cutting out a tap portion (9), and directly below the surface portion (8) in the horizontal direction is a first diameter (d1) and the first diameter (d1) is smaller than an outer diameter (d) of the container body (1). Further, the second diameter (d2) of the accordion-shaped portion (5) is larger than the first diameter (d1) of the accordion-shaped portion (5), but smaller than the outer diameter (d) of the container body (1).

Also, connected thereto is a step configuration when viewed from the side, which has the third diameter (d3) which is larger than the second diameter (d2) and smaller than the outer diameter of the container body (1). However the number of steps is not limited to 3 as in the above example, and may be any plural number of steps.

The cross-sectional shape of the container body (1) is not limited to a perfect circle, but can be an elliptical shape as in FIGS. 10 and 11 or a square shape as in FIGS. 12 and 13. Further, the shape in the height (length) direction may be a cylinder shape as in FIG. 1, or a barrel shape as in FIG. 6 or an hourglass drum shape as in FIG. 7. Further, the accordion-shaped portions (5) are not necessarily configured to be parallel in the horizontal direction, but may be a spiral (16) as in FIG. 9.

The container body (1) is manufactured by a cupping press molding means or the like and transported, for example, to a filling plant to be filled with beer. In this case, if the height of the container body (1) is reduced by a suitable means, as shown in FIG. 15, a large amount of the container bodies (1) can be transported at once, and then once again lengthened at the filling plant.

In the present situation, most beer filling plants use means for automatically forming the cylindrical cans from flat metal sheets using a cupping press process at the plant. Further, the cans are usually automatically filled with beer and the surface portion (8) is capped and then the labels are pasted on. The process is thus a continuous chain process.

Suppose that all the contents of the container body (1) are consumed. At this point, the surface portion (8) of the container body (1) is pressed with a comparatively strong force (f) towards the lower direction. This force (f) presses down the inner side vicinity (periphery) of a first fold (11) of the accordion-shaped portions (5) with a force (f1) via the surface portion (8). Consequently, the outer side vicinity (periphery) of the first fold (11) moves upward by a force (f2). In this manner, a number of steps/fold plate members (3 in the drawings) of the accordion-shaped portions (5) carry out this type of action. However, in this example, the first fold plate member (11) of the accordion-shape portion (5) has a smaller diameter (d1) than that of a second fold plate member (12). The third diameter (d3) of a third fold plate member (13) is larger than the second diameter (d2) of the second fold plate member (12), and is the same as that of the outer diameter (d) of the container body (1). Thus, at a fourth fold plate member (14), the force of the tap portion (9) moves the inner side thereof in the upward direction and converts to a force which presses the outer side in the downward direction.

Consequently, the upper portion and the portions below the upper portions of the accordion-shaped portion (5) of the container body (1) form the symbol ">". The force (f1) which presses the inner sides of the fold plate members (11 to 13) in a downward direction and the force (f3) which pushes up the inner side of tile wall (14) which is below, are in proportion to each other, and the force (f4) which presses the outer side of the fold plate member (14) in a downward direction is in proportion and this force hinders the force (restoring force) that attempts to cause the container body (1) to return to its original shape and thus the crushed state illustrated in FIG. 16 is retained.

As illustrated in FIG. 17, the upper area of the first fold plate member (11) and if necessary, of the second fold plate member (12) and the third fold plate member (13) is formed as an are configuration (15) protruding in the outside direction of the upper area. If the lower area is made shorter than the upper area, and pressed down, and a first fold plate member (11) Such as that of FIG. 16 is caused to turn over, the upper are configuration (15), now cancels the force that presses the fold plate members in the downward direction. Thus the state in which the container body (1) is pressed and crushed is maintained semi-permanently and almost never returns to the original state.

Consequently, when repeated experiments were carried out with the container body (1), the height (volume) was reduced to ⅓ to ¼ or less and thus when thrown in a trash can, the space used was decreased considerably.

The main effect of the above-described present invention is that when the container is disposed of, the volume of the container can be greatly reduced. Thus the number of containers that can be accommodated in a trash can or the like, is considerably increased.

Further, a large amount of the container which has been reduced in size, can be transported at the same time and thus the labor cost for the trash collection are considerably decreased.

The exterior of the container of the present invention is esthetically pleasing and thus appealing to the consumer. The bellow shape of the container prevents friction. Thus the slipping of the container and spillage of the contents of the container during use is prevented.

Further, even when the container of the present invention is in what is referred to as a crushed state, the container is esthetically pleasing with respect to its design and can be used in that state, as another container.

What is claimed is:

1. A metal container capable of retaining a state of being reduced in a longitudinal direction, comprising: a surface portion, a tap portion on the surface portion, a bottom, and a container body thereof being formed as an accordion-shape portion, wherein the surface portion has an outside periphery connected with an upper rim of the container body and the bottom has an outside periphery connected with a lower rim of the container body; and the accordion-shaped portion includes a upper group of fold plate members increasing gradually in length downwards as measured on a cross-sectional plane taken along a longitudinal axis of the container, each upper-group fold plate member, except a last upper-group plate member, having an inside periphery connected with an inside periphery of an upper-group fold plate member by a fold therebetween, and each upper-group plate member, except a first upper-group plate member, having an outside periphery connected with an outside periphery of an upper-group fold plate member by a fold therebetween, the first upper-group fold plate member having an outside periphery connected with the outside periphery of the surface portion: and a lower group of fold plate members maintaining a same length as measured on the cross-sectional plane, each lower-group plate member, except a first lower-group plate member, having an inside periphery connected with an inside periphery of an lower-group plate member by a fold there-between, and each lower-group plate member, except a last lower-group plate member, having an outside periphery connected with an outside periphery of an lower-group plate member by a fold therebetween, the first lower-group fold plate member having an inside periphery connected with an inside periphery of the last upper-group fold plate member, each lower-group plate member is longer than each upper-group fold plate member, and said fold plate members are so formed that a force along the longitudinal direction applied to the surface portion of said container reaches a balance between a downward force on the outside periphery of the surface portion and inside peripheries of the upper-group fold plate members and a upward force on inside peripheries of the lower-group fold plate members such that a part of the surface portion and the upper-group fold plate members are collapsed downward and the inside peripheries of the lower-group fold plate members are raised downward, and a balance between a upward force on outside peripheries the upper-group fold plate members and a downward force on outside peripheries of the lower-group fold plate members such that the outside periphery of the upper-group fold plate members are raised upward and the outside peripheries of the lower-group fold plate members are collapsed downwards.

2. The metal container capable of retaining a state of being reduced in a longitudinal direction according to claim 1, wherein a diameter of one outer periphery configuration of the accordion-shaped portion of the container body is smaller than a diameter of another outer periphery configuration.

3. The metal container capable of retaining a state of being reduced in a longitudinal direction according to claim 1, wherein a diameter of one outer periphery configuration of the accordion-shaped portion of the container, body is smaller than a diameter of another outer periphery configuration, and is gradually increased towards the other outer periphery configuration to have the same diameter.

4. The metal container capable of retaining a state of being reduced in a longitudinal direction according to claim 1, wherein a diameter of an outer periphery configuration of the accordion-shaped portion (5) of the container body (1), is smallest at a substantially central portion of said container body, and said diameter increases toward outer directions.

5. The metal container capable of retaining a state of being reduced in a longitudinal direction according to claim 1, wherein hill portions (3) and valley portions (4) of the outer periphery configuration of the accordion-shaped portion (5) of the container body (1) are formed as alternating spiral shapes.

6. A metal container according to claim 1, wherein the overall shape of the container body is suitably selected from an elliptical cylinder, a circular cylinder, a rectangular column, a truncated cone, a truncated pyramid, an hourglass drum shape and a barrel shape.

7. A metal container according to claim 1, the tap portion is selectively jut out in an upward direction from a central portion of said container body.

8. The metal container capable of retaining a state of being reduced in a longitudinal direction according to claim 2, wherein hill portions (3) and valley portions (4) of the outer periphery configuration of the accordion-shaped portion (5) of the container body (1) are formed as alternating spiral shapes.

9. The metal containers capable of retaining a state of being reduced in a longitudinal direction according to claim 3, wherein hill portions (3) and valley portions (4) of the outer periphery configuration of the accordion-shaped portion (5) of the container body (1) are formed as alternating spiral shapes.

10. The metal container capable of retaining a state of being reduced in a longitudinal direction according to claim 4, wherein hill portions (3) and valley portions (4) of the outer periphery configuration of the accordion-shaped portion (5) of the container body (1) are formed as alternating spiral shapes.

11. A metal container according to claim 1, wherein a horizontal cross-section of the container body is shaped as an ellipse, a circle or a rectangle.

12. A metal container body according to claim 1, wherein a label on which product containers, product information and trademarks are printed, is fixed onto the outer periphery of the container body.

13. A method of reducing a metal container such that the metal container is capable of retaining a state of being reduced in a longitudinal direction, comprising the steps of:

providing, the metal container with a surface portion, a tap portion on the surface portion, a bottom, and a container body being formed as an accordion-shaped portion, the surface portion having an outside periphery connected with an upper rim of the container body and the bottom having an outside periphery connected with a lower rim of the container body, and the accordion-shape portion including a upper group of fold plate members increasing gradually in length downwards as measured on a cross-sectional plane taken along a longitudinal axis of the container, each upper-group fold plate member, except a last upper-group plate member, having an inside periphery connected with an inside periphery of an upper-group fold plate member by a fold therebetween, and each upper-group plate member, except a first upper-group plate member, having an outside periphery connected with an outside periphery of an upper-group told plate member by a fold therebetween, the first upper-group fold plate member having an outside periphery connected with the outside periphery of the surface portion; and a lower group of fold plate members maintaining a same length as measured on the cross-sectional plane, each lower-group plate member, except a first lower-group plate member, having an inside periphery connected with an inside periphery of an lower-group plate member by a fold therebetween, and each lower-group plate member, except a last lower-group plate member, having an outside periphery connected with an outside periphery of an lower-group plate member by a fold therebetween, the first lower-group fold plate member having an inside periphery connected with an inside periphery of the last upper-group fold plate member, each lower-group plate member is longer than each upper-group fold plate member; and applying a force along the longitudinal direction applied to the surface portion of said container reaches a balance between a downward force on the outside periphery of the surface portion and inside peripheries of the upper-group fold plate members and a upward force on inside peripheries of the lower-group fold plate members such that a part of the surface portion and the upper-group fold plate members are collapsed downward and the inside peripheries of the lower-group fold plate members are raised upward, and a balance between a upward force on outside peripheries of the upper-group fold plate members and a downward force on outside peripheries of the lower-group fold plate members such that the outside periphery of the upper-group plate members are raised upward and the outside peripheries of the lower-group fold plate members are collapsed downwards.

14. A method of reducing the container body according to claim 13, wherein a horizontal cross-section of the container body is shaped as an ellipse, a circle or a rectangle.

15. A method of reducing the container body according to claim 13, wherein a label on which product contents, product information and trademarks are printed, is fixed onto the container body.

* * * * *